United States Patent [19]

Pickles

[11] 4,010,927

[45] Mar. 8, 1977

[54] SEAT ADJUSTING MECHANISM

[75] Inventor: Joseph Pickles, Birmingham, Mich.

[73] Assignee: Ferro Manufacturing Corporation, Detroit, Mich.

[22] Filed: Dec. 3, 1975

[21] Appl. No.: 637,160

[52] U.S. Cl. ..... 248/420; 248/429

[51] Int. Cl.[2] ..... F16M 13/00

[58] Field of Search ..... 248/393, 394, 395, 396, 248/399, 419, 420, 421, 429, 430

[56] References Cited

UNITED STATES PATENTS

| | | | |
|---|---|---|---|
| 2,149,945 | 3/1939 | Whedon et al. | 248/419 |
| 2,161,367 | 6/1939 | McGregor et al. | 248/394 |
| 2,170,923 | 8/1939 | Jacobs | 248/395 |
| 2,792,873 | 5/1957 | Herider et al. | 248/419 |
| 2,827,947 | 3/1958 | Wilkinson | 248/419 |
| 2,907,371 | 10/1959 | Scott | 248/419 |
| 2,927,627 | 3/1960 | Lohr | 248/395 |
| 2,929,438 | 3/1960 | Homier | 248/393 |
| 3,022,035 | 2/1962 | Pickles | 248/395 |
| 3,109,622 | 11/1963 | Heyl | 248/420 |
| 3,167,297 | 1/1965 | Lohr | 248/419 |

*Primary Examiner*—Lawrence J. Staab
*Attorney, Agent, or Firm*—Whittemore, Hulbert & Belknap

[57] ABSTRACT

A seat adjusting mechanism including separate devices for effecting fore and aft adjustment and substantially vertical adjustment of the seat. These devices are interconnected by a spring in such a way that the spring simultaneously biases the seat supporting structure forwardly and upwardly.

3 Claims, 4 Drawing Figures

SEAT ADJUSTING MECHANISM

BRIEF SUMMARY OF THE INVENTION

The present invention relates to seat adjusting mechanism and is particularly relevant to the so-called four-way seat adjuster in which the seat is adjusted generally fore and aft and vertically. Preferably, the support structure is so arranged that upon forward movement of the seat it is slightly elevated in accordance with the fore and aft movement. However, an independent vertical adjustment is provided.

So far as the present invention is concerned any of the usual adjusting devices may be employed. These include rack and pinion devices in which the pinion is usually connected to a reversible electric motor. They also include screw and nut devices in which the nut is usually mounted for translation while its rotation is prevented and it is advanced or retracted by rotation of an elongated screw which is suitably connected to a reversible electric motor, either through a flexible drive cable, a worm and worm gear transmission, or the like.

Usually, the construction comprises a stationary base including a pair of stationary supports adjacent opposite ends of the seat which are fashioned to provide slideways or tracks. Slidable longitudinally along the slideways or tracks are carriages which are thus adapted to have substantially fore and aft movement, although this movement may be caused to take place in such a way as to slightly elevate the carriages as they are moved forwardly. In addition, the slideways or tracks may be given a slight curvature so that the seat is automatically slightly tilted forwardly as it moves forwardly and upwardly.

The seat itself is connected to a frame or supports adjacent end which in turn are connected through lift levers to the carriages. In the case of a so-called four-way seat, power means is connected to the bell crank which includes one of the lift levers and this lift lever is connected by a rigid link to a corresponding lift lever adjacent the opposite edge of the seat. Accordingly, when the lift levers are actuated, the seat in its entirety is elevated substantially vertically relative to the carriages.

DETAILED DESCRIPTION

Figure 2:
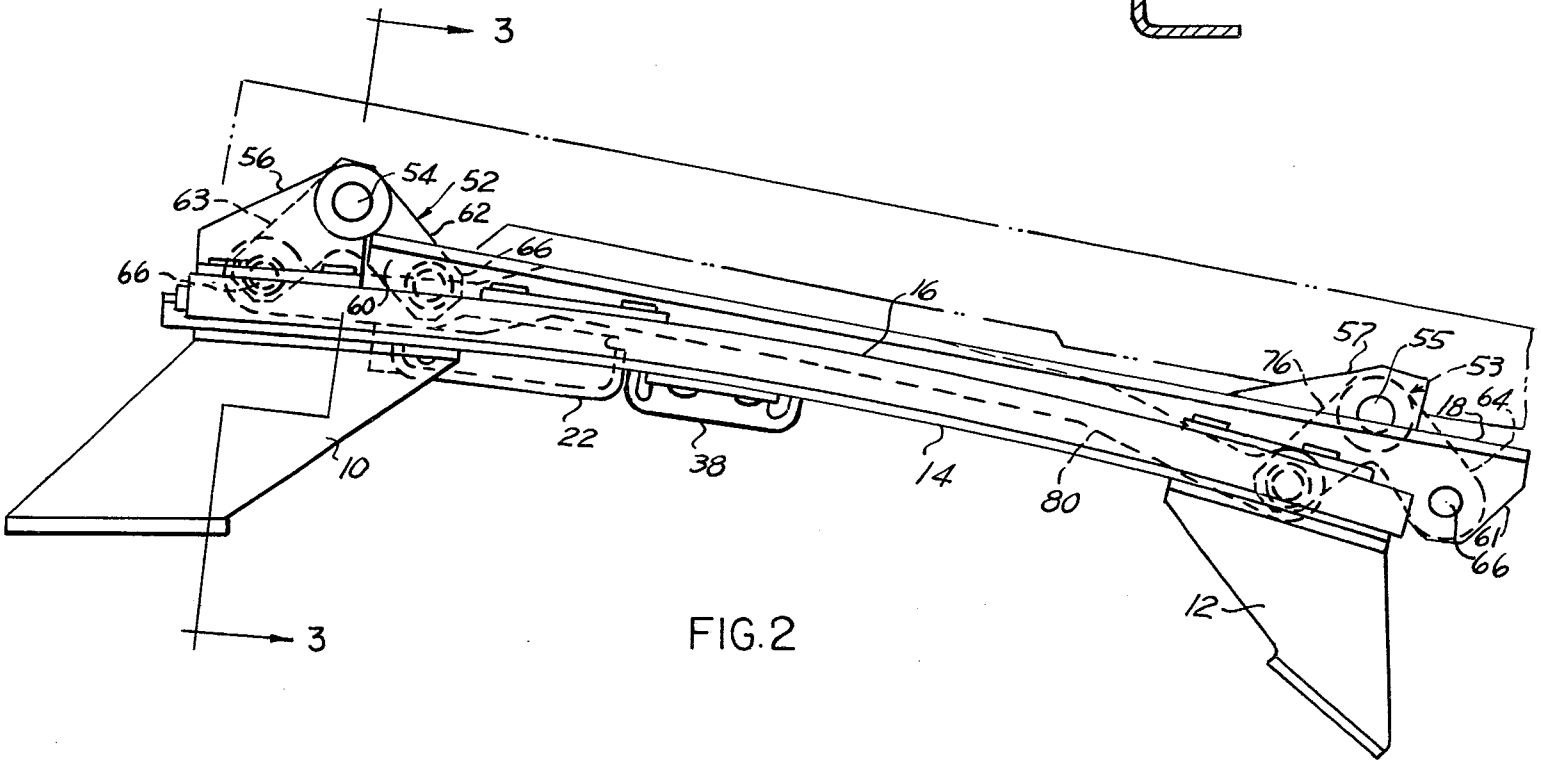
FIG. 2 is a side elevational view of the seat adjusting mechanism.

Referring now to the drawings, the seat adjusting mechansim comprises front mounting brackets 10, rear mounting brackets 12, and a pair of slideways or track-forming rail members 14 mounted at each side of the seat. Slidable generally longitudinally of the slideways 14 are carriages 16. As best illustrated in FIG. 2 the slideways 14 and the carriages 16 have a slight arcuate curvature. In addition, it will be observed from FIG. 2 that the front mounting brackets 10 maintain the front end of the sliding carriages at a higher elevation than the rear end. Accordingly, as the seat, carried by seat supporting members 18, is moved forwardly on the slideways 14, it is slightly elevated and slightly tilted in a forward direction.

Slide blocks 20 are provided on outwardly extending flanges on the slideways and fit within the channels provided at opposite sides of the carriage. The slide blocks 20 are preferably formed of a low friction plastic material and provide for quiet and substantially free sliding movement. A motor and transmission support 22 is connected between carriages 16 and mounted thereon is a motor assembly 24 comprising a pair of independently operable and reversible electric motors.

The output of the motors may be through a flexible drive cable 26 received within a flexible tubular housing 28. Two such output drive constructions are provided, one leading to a vertical transmission housing 30, and the other to a similar horizontal transmission housing 32. The output from the housings 30 and 32 are screw shafts 34 and 36 respectively. Support 38 extends between and is connected to the slideways or tracks 14 and accordingly is stationary.

Mounted on the stationary support 38 are brackets 40 and 42 having flanges 44 and 46 respectively. Intermediate the flanges 44 and 46 is a nut 48 pivoted to flanges 44 and 46 for rocking movement about an axis extending transversely of the vehicle but retained against rotation. The transmission housing 32 includes means for driving the screw shaft 36 in rotation. Accordingly, when the appropriate motor included in the motor assembly 24 is driven in the proper direction, the screw shaft 36 is rotated causing nut 48 to advance along the screw shaft, thus imparting generally fore and aft movement to the carriage structure including carriages 16. When the slide structure reaches its limiting position the nut 48 engages a nut stop element 50 which stalls the motor without causing jamming of the threads.

The mechanism for effecting substantially vertical adjustment of the seat mounted on the seat supports 18 comprises a front bell crank 52 and a rear bell crank 53 pivoted as indicated at 54 and 55 respectively between upstanding ears 56 and 57 respectively connected to carriages 16 by suitable means such as the rivets 58. Seat supports 18 have depending ears 60 and 61 at front and rear ends respectively which are pivotally connected to arms 62 and 64 of the bell cranks, the pivot means being indicated at 66.

Figure 1:
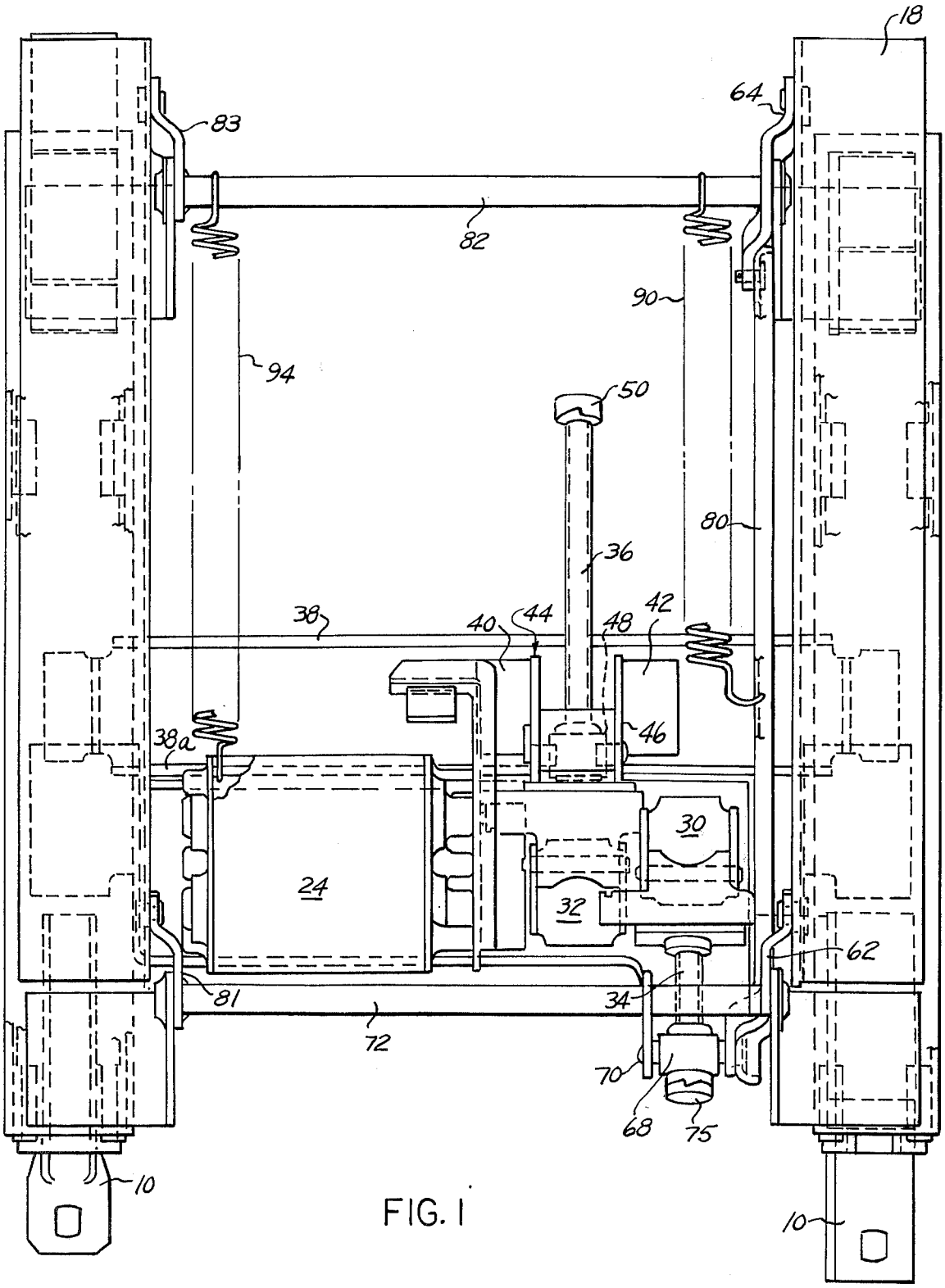
FIG. 1 is a plan view of the seat adjusting mechanism.

The means for directly actuating the front bell crank 52 comprises the screw shaft 34 carrying a nut 68 which is pivotally secured between arm 70 fixed to a torsion bar 72, and arm 63 of the bell crank 52. Since the nut 68 is held against rotation about its axis, actuation of the appropriate motor in the motor assembly 24 causes the nut 68 to move in a fore and aft direction. As illustrated in FIG. 1, the nut is in its foremost position engaging with the nut stop 75 and accordingly, the seat supports 18 are in the lowermost position. When the shaft 34 is rotated in the appropriate direction, the nut 68 is caused to move rearwardly with respect to the carriage structure including carriages 16 and this movement of course raises the lift arms 62.

In order to effect simultaneous rotation of the bell crank 53, its arms 76 is connected to the similarly disposed arms 63 of the bell cranks 52 by a rigid link 80. In order to insure identical simultaneous actuation of the seat elevating mechanism at opposite sides of the seat, the torsion bar 72 is rigidly connected to a front lift lever 81 at the opposite side of the seat which is identically disposed with the lift arm or lever 62 of the bell crank 52. Similarly, the rear torsion bar 82 is rigidly connected between the left rear bell crank 53 and a lift arm 83 at the opposite end of the seat disposed in paralellism with the lift arm 64.

From the foregoing it will be observed that the stationary structure comprises the mounting brackets 10 and 12, the slideways or tracks 14, and the transversely extending support or tie plate 38. The structure which is movable in its entirety in the generally fore and aft direction comprises the carriages 16, the transverse support 22, the mounting brackets 56 and 57, the torsion bars 72 and 83, and of course the motor assembly 24, the transmission housings 30 and 32. The structure which is movable generally vertically with respect to the carriage structure is made up of the seat supports 18 which are of course fixedly connected at opposite ends of a rigid seat frame (not shown). Accordingly, any biasing means extending between the stationary structure as above described, and the carriage structure can apply a biasing force to the slidable carriage structure. Similarly, any resilient means connected between either of the bell cranks 52 or 53, or the rigid link 80 interconnecting these bell cranks, and a part of the carriage or stationary structure can apply a biasing force tending to rock the bell cranks in a direction to lift the vehicle seat and hence, to counterbalance its weight and the weight of its occupants.

As best seen in FIG. 1, a tension spring 90 is provided which as shown is connected to extend between the torsion bar 82 and an intermediate portion of the rigid link 80 which interconnects the bell cranks 52 and 53, and more particularly arms or levers 63 and 76 thereof.

Accordingly, the tension spring 90 applies a counterclockwise bias to the bell cranks 52 and 53 as seen in FIG. 2, tending to raise lift arms 62 and 64 respectively, thus providing a force which partly counterbalances the weight of the seat and/or any passengers thereon. It will be observed that this spring, since it acts between elements movable with the generally horizontally movable slide structure, does not apply any biasing or counterbalancing force to the slide structure including carriages 16.

A second spring 94 is provided to effect a forward biasing movement of the seat support and slide structure. As illustrated, this spring has an end portion extending around the torsion bar 82 and a hook at its forward portion extending through an opening in the flange 38*a* of the tie plate 38. Since this tie plate 38 is fixed to the slideways or track members 14, it is stationary and the spring 94 is accordingly effective to provide a force tending to move the seat structure forwardly. Inasmuch as the slideways or track forming members 14 incline forwardly and upwardly, this force tends to counter-balance the gravitational force tending to move the seat structure to the rear.

The foregoing constructions requires separate springs for counterbalancing vertically applied weight to the seat structure and counterbalancing the component of forces tending to move the seat rearwardly.

Figure 3:
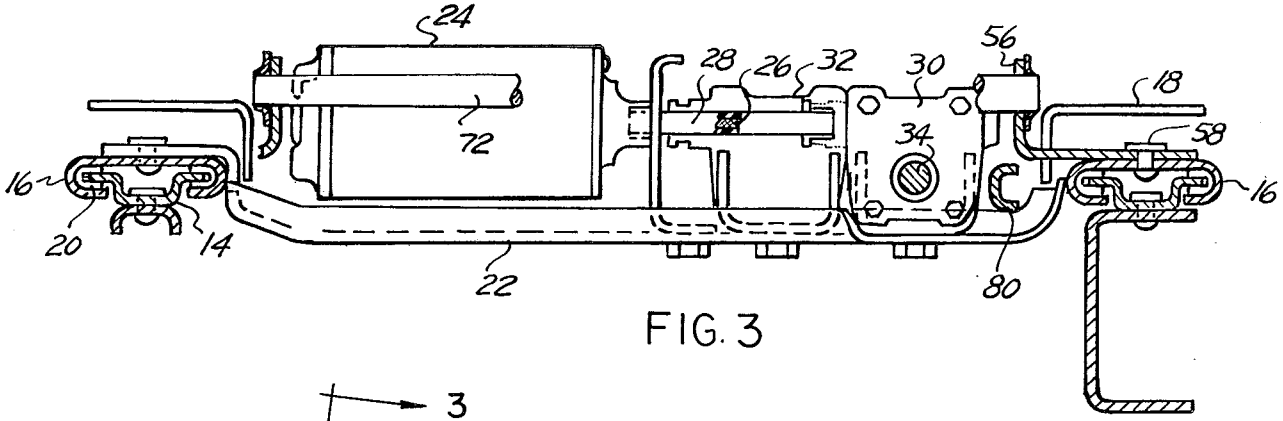
FIG. 3 is a sectional view along the line 3—3, FIG. 2.
Figure 4:
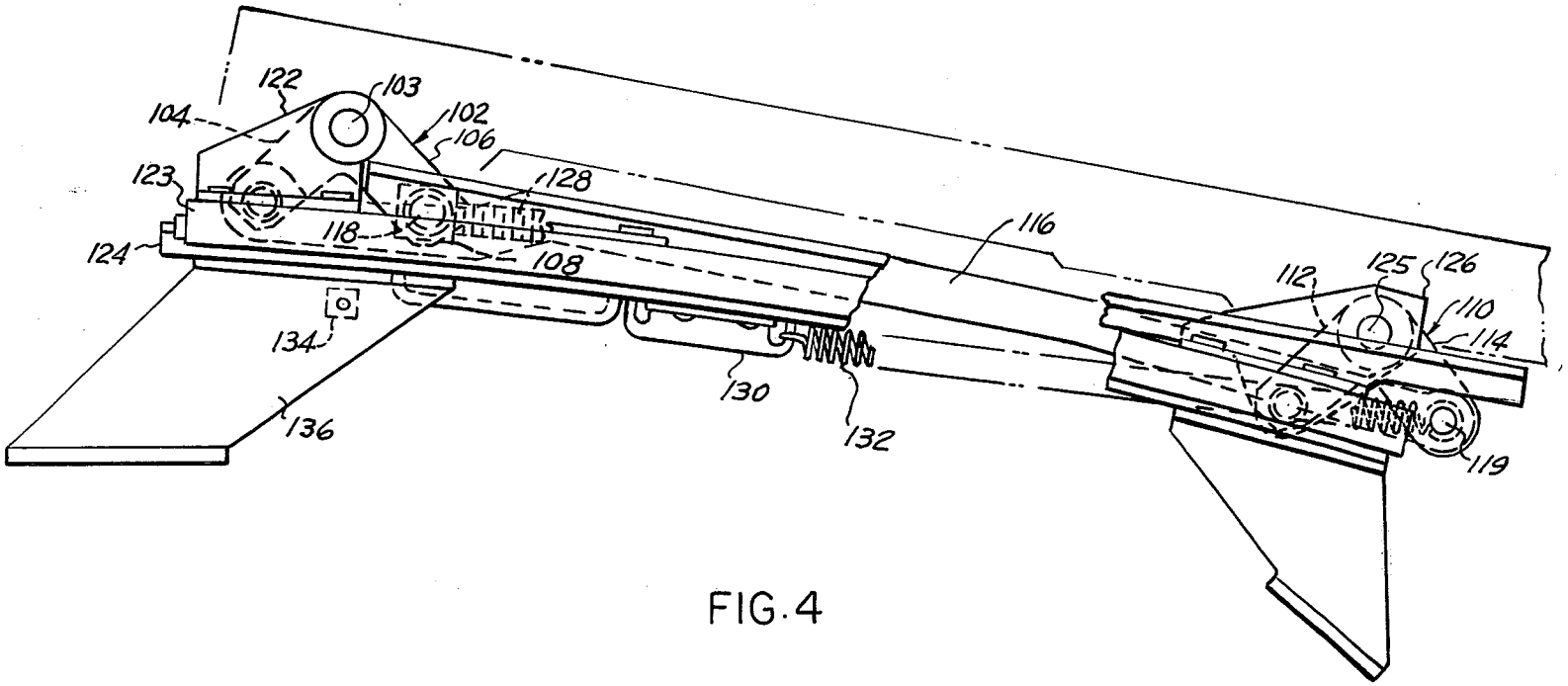
FIG. 4 is a more or less diagrammatic side elevational view showing a different embodiment of the invention.

In FIG. 4 there is illustrated a different embodiment of the present invention, which is similar to that disclosed in FIGS. 1–3 except for a different utilization of the bell cranks, which permits a single spring to provide both upward and forward bias to the seat.

In this embodiment the front bell crank 102 is pivoted at 103 and comprises a front lift arm 104 and a rear actuating arm 106. The bell crank is connected to a torsion bar coaxial with pivot axis 103 and identical with the bar 72 of FIG. 1. It will be noted that in FIG. 4 the front arm 104 is the lift arm, whereas in FIG. 2 it is the rear arm 62 which is the lift arm.

The actuating nut 108 is pivotally connected to actuating arm 106, and, as in the embodiment of the invention illustrated in FIGS. 1–3, it will be connected between an arm fixed to the torsion bar and the adjacent arm 106 of the bell crank. Accordingly, as seen in FIG. 4, it is clockwise movement of bell crank 102 which raises the front edge of the seat.

The rear bell crank comprises front lift arm 112 and rear actuating arm 114. A rigid link 116 is pivotally connected at 118 to actuating arm 106 and at 119 to arm 114, which may be a separate arm fixed to a rear torsion bar identical with bar 82 of FIG. 1.

Bell crank 102 is pivotally mounted at 103 on ear 122 fixed to the forward end of carriage 123 which is slidable on slideway or track 124, and bell crank 110 is similarly pivotally mounted at 125 on ear 126 at the rear thereof. Pivots 103 and 125 are also coaxial with torsion bars identical with the bars 72 and 82 of FIG. 1.

Since link 116 is rigid, it will be apparent that bell cranks 102 and 110 move identically when nut 108 is caused to move longitudinally of an actuating screw, a portion of which is seen at 128, driven by motor means as described in connection with the embodiment of the invention of FIGS. 1–3.

Since bell cranks 102 and 110 move clockwise to effect upward movement of the seat, it is now possible to connect a single tension spring which will simultaneously provide forward and upward bias to the seat construction. Tie plate 130 is fixed to extend between stationary slideways or track members 124 and hence, forms a convenient anchor for the forward end of a tension spring 132. Alternatively of course, the forward end of the spring may be anchored to any fixed point, as for example a suitable bracket whose location is diagrammatically indicated at 134 on the side of seat support bracket 136.

The rear end of the spring is connected to arm 114 and accordingly tension in the spring 132 biases bell crank 110 in a clockwise direction, thus biasing the rear edge of the seat, connected to lift arm 112, upwardly. Clockwise torque is applied to front bell crank by link 116, thus applying an upward bias to the front edge of the seat. At the same time, the tension of spring 132 applies a forward bias to the seat slide or carriage assembly on rails 124.

It will of course be apparent that the rear end of tension spring 132 could be connected to rigid link 116, rearward bias of which will apply clockwise torque to both front bell crank 102 and rear bell crank 110.

What I claim as my invention is:

1. An adjustable vehicle seat, comprising stationary rail means adapted to extend generally horizontally of a vehicle, a carriage assembly slidable longitudinally on said rail means, seat elevating means on said carriage assembly including bell cranks pivoted to the front and rear edges of said carriage assembly rotatable about axes adapted to extend transversely of the vehicle, a seat connected to said bell cranks, said bell cranks each having a lift arm extending forwardly and downwardly from its pivot axis when the seat is in lowered position and swingable upwardly to raise said seat, and an actuating arm extending downwardly and rearwardly from its pivotal axis and swingable forwardly to raise said seat, a rigid link connecting longitudinally aligned actuating arms of said bell cranks, resilient counterbalance means extending generally parallel to said rail means, said counterbalance means comprising a tension spring having its forward end fixed with respect to the vehicle and its rear end attached to the actuating arm of a bell crank at the rear of said carriage assembly to apply simultaneously a forward bias to said carriage assembly and a torque to said bell cranks in a direction to rotate said bell cranks in a direction to elevate said seat.

2. The construction as defined in claim 1 in which said rail means is inclined slightly forwardly and upwardly.

3. The construction as defined in claim 2 in which said rail means has a slightly upwardly convex curvature.

* * * * *